US012173999B2

(12) United States Patent
Gizowski et al.

(10) Patent No.: US 12,173,999 B2
(45) Date of Patent: Dec. 24, 2024

(54) ADJUSTABLE OUTSERT SYSTEM

(71) Applicant: Ethics Archery LLC, Vale, NC (US)

(72) Inventors: Frederick Scott Gizowski, Vale, NC (US); Bruce Ritter-Clark, Bremen, IN (US)

(73) Assignee: Ethics Archery LLC, Vale, NC (US)

( * ) Notice: Subject to any disclaimer, the term of this patent is extended or adjusted under 35 U.S.C. 154(b) by 0 days.

(21) Appl. No.: 16/284,153

(22) Filed: Feb. 25, 2019

(65) Prior Publication Data

US 2019/0265007 A1 Aug. 29, 2019

Related U.S. Application Data

(60) Provisional application No. 62/635,145, filed on Feb. 26, 2018.

(51) Int. Cl.
*F42B 6/08* (2006.01)
*F42B 6/04* (2006.01)

(52) U.S. Cl.
CPC . *F42B 6/08* (2013.01); *F42B 6/04* (2013.01)

(58) Field of Classification Search
CPC ..... F42B 6/08; F42B 6/04; F42B 12/362
USPC ..... 473/578
See application file for complete search history.

(56) References Cited

U.S. PATENT DOCUMENTS 3,388,696 A 6/1968 Hoverath
3,910,579 A 10/1975 Sprandel
4,175,749 A 11/1979 Simo
4,534,568 A 8/1985 Tone
4,943,067 A * 7/1990 Saunders ..... F42B 6/04 403/13
5,269,534 A * 12/1993 Saunders ..... F42B 6/08 403/343
5,482,293 A 1/1996 Lekavich
5,609,147 A 3/1997 Withorn, Jr.
5,971,875 A 10/1999 Hill
6,478,700 B2 11/2002 Hartman
6,595,880 B2 7/2003 Becker
6,623,385 B1 * 9/2003 Cole ..... F42B 6/04 473/578
7,207,908 B1 4/2007 Gizowski
7,608,001 B2 10/2009 Palomaki
8,057,330 B2 11/2011 Blosser
8,668,605 B1 3/2014 Huang
9,410,773 B2 * 8/2016 Greenwood ..... F42B 6/04
(Continued)

OTHER PUBLICATIONS

U.S. Appl. No. 62/635,145, filed Feb. 26, 2018 titled Adjustable Outsert System.

*Primary Examiner* — John A Ricci
(74) *Attorney, Agent, or Firm* — Dinsmore & Shohl LLP

(57) ABSTRACT

An adjustable outsert system with a point, a sleeve, and a post when assembled. The system is configured to be inserted into an end of an arrow shaft that comprises a hollow receiving portion. The point can be any type of arrowhead, is axially aligned with the post and the sleeve, and can be of any screw-in type. The post has receiving portion for attachment to the axially aligned end of the point, and comprises provision of cut points to facilitate the adjustment of the weight of the target point to a more precise weight based on the choice of the archer. The sleeve is cylindrical and of a dimension to allow it to be slipped over the end of the post following insertion into the receiving portion of the arrow shaft.

7 Claims, 3 Drawing Sheets

(56) References Cited

U.S. PATENT DOCUMENTS

| | | | | |
|---|---|---|---|---|
| 9,638,499 | B2 | 5/2017 | Perry | |
| 9,658,036 | B2 * | 5/2017 | Zobell | F42B 6/08 |
| 9,933,239 | B2 | 4/2018 | Johnson | |
| 2018/0335285 | A1 | 11/2018 | Gizowski | |

* cited by examiner

ADJUSTABLE OUTSERT SYSTEM

CROSS-REFERENCE TO RELATED APPLICATIONS

This application claims the benefit of U.S. Provisional Application No. 62/635,145, filed Feb. 26, 2018.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to the field of archery. More particularly, the present invention relates to an outsert system. This is composed of an internal and external adjustable footer system. Particularly to an outsert that provides the facility for adjusting the weight to achieve perfect dynamic spine reaction in the arrow shaft.

2. Background of the Invention

The bow and arrow is a projectile weapon system that predates written history. The bow is a flexible arc which shoots aerodynamic projectiles called arrows. Generally, the two ends of the bow are joined together with a string such that when the string is drawn back, the ends of the bow are flexed. An arrow is placed upon the string and the string is drawn back. When the string is released, the potential energy of the flexed stick is transformed into the velocity of the arrow. Bows and arrows have historically been important weapons, but are used primarily for hunting and the sport of archery today.

An arrow generally consists of a shaft with an arrowhead attached to the front end, with fletchings and a nock at the other end. Modern arrows may be made of any suitable material, including but not limited to carbon fiber, aluminum, fiberglass, and wood shafts. Carbon shafts have the advantage that they do not bend or warp, but they can often be too light weight to shoot from some bows and are expensive. Aluminum shafts are less expensive than carbon shafts, but they can bend and warp from use. Wood shafts are the least expensive option but often will not be identical in weight and size to each other and break more often than the other types of shafts.

The end of the arrow that impacts the target is the arrowhead. Historically, arrowheads have been made from various materials including flint, bone, horn, or metal. Most modern arrowheads are made of steel, but wood and other traditional materials are still used occasionally. Typically, the arrowhead is provided or manufactured separately from the arrow shaft and is attached to the arrow. For example, the arrowhead can be attached by tangs or sockets. There are several different types of arrowheads. Among the various types are the following:

- Bodkin points are short, rigid points with a small cross-section.

- Blunts are unsharpened arrowheads occasionally used for types of target shooting, for shooting at stumps or other targets of opportunity, or hunting small game when the goal is to stun the target without penetration.
- Judo points have spring wires extending sideways from the tip. These catch on grass and debris to prevent the arrow from being lost in the vegetation. These are usually used for practice and for small game.
- Broadhead arrowhead is usually triangular or leaf-shaped and has a sharpened edge or edges. Broadheads are commonly used for hunting.
- Target points are bullet-shaped with a sharp point, designed to penetrate targets easily without causing excessive damage to them.
- Field points are similar to target points and have a distinct shoulder, so that missed outdoor shots do not become as stuck in obstacles such as tree stumps. They are also used for shooting practice by hunters, by offering similar flight characteristics and weights as broadheads, without getting lodged in target materials and causing excessive damage upon removal.
- Other types of points known by those skilled in the art as game getters or fishing points.

Archery hunting and target archery are popular sports that require a number of skills and talents that are honed and developed through years of target practice and actual hunting. Certainly one of the most critical skills is developing the ability to bring the bow to full draw for obtaining maximum velocity for the arrow upon release and optimum shot placement on the target, whether the target is an archery target or a game animal. This requires both physical strength and finding a bow that has a comfortable draw weight (poundage of pull to get the bow to full draw) for that individual As noted, archery arrows typically include a hollow shaft. Such shafts may be made of many materials. In more recent years, they are often manufactured from lighter materials such as composite carbon fiber shafts. These lighter arrow shafts have the principal advantage of higher velocities when launched from the same bow. Such higher velocities result in a flatter arrow trajectory. The practical advantage of flatter trajectory is that a misjudgment by an archer of the range to a target has less effect on the point of impact. However, these lighter shafts have disadvantages as well. Due to material and structural considerations in designing arrow shafts for reduced weight, it became necessary to both increase shaft outside diameter and reduce wall thickness relative to the prior art. In some lighter weight arrows, the wall thickness must be reduced and the diameter of the arrow, both the inside diameter and the outside diameter, must be increased to maintain adequate spine. This process of thinning the wall and increasing shaft diameter has, however, practical limitations. At some point, if taken to an illogical extreme, the arrow would have mechanical properties that result in little to no resistance to side loads or crushing. This is because, when used with an arrowhead, the shaft end is subjected to impact forces when the arrow hits the desired target. These forces can potentially damage lightweight materials of the shaft, necessitating repair or replacement of the arrow shaft.

In addition to the concerns regarding the resistance to impact, there remains the need to ensure that, while in use, the alignment and balance between the axis of the arrowhead and the shaft, including accounting for the weight distribution, as this is important for maintaining the desired flight of the arrow without wobble or drift from the expected trajectory.

The following patents disclose various improvements in the design of the point and attachment of the point to the shaft to improve arrow flight control, stability, and accuracy:

U.S. Pat. No. 3,388,696 to Hoverath discloses a magazine and blowpipe for projecting elongate projectiles and which includes a tubular pipe, a magazine, and a plurality of projectiles stored in the magazine and ejected one at a time from a discharge end of the pipe;

U.S. Pat. No. 3,910,579 to Sprandel discloses a swivel action adaptor for securing an arrowhead to the front end of an arrow shaft that includes a bushing that is cemented to the forward end of the arrow shaft and a spindle mounted to the bushing and having a tapered end that is cemented in the socket of the arrowhead. Sprandel teaches an arrangement having in which the arrow does not swivel after the arrow strikes the game, unlike the present invention;

U.S. Pat. No. 4,175,749 to Simo discloses an arrowhead body for attachment between the nosepiece and the head end of the arrow shaft, and which includes an adaptor having a having a rearward adapter shaft for insertion into the arrow shaft and an opposite forwardly extending adaptor shaft for attachment to the arrowhead body with the adaptor shafts and the adaptor in axial alignment with the arrow shaft and the arrowhead body;

U.S. Pat. No. 4,534,568 to Tone discloses a low frictional rotational element for interconnecting a broad blade arrowhead to the leading end of an arrow shaft, and which includes a housing for permanent installation to the leading end of the arrow shaft and an insert for disposition within the housing, with the insert including annular ridges that serve as low friction bearing surfaces against the inner annular surface of the housing. The insert includes a threaded hole to receive the threaded stud of the arrowhead;

U.S. Pat. No. 4,943,067 to Saunders discloses an arrow insert for a hollow arrow shaft that includes annular alignment rings, an enlarged shoulder, and a glue trap for gluing the insert to the inside annular surface of the arrow so that a fieldpoint can be secured to the insert and in position at the front end opening of the shaft of the arrow;

U.S. Pat. No. 5,609,147 to Withorn discloses an arrow thread tracking apparatus for a bow that includes a bolt assembly secured to the bow and a thread attached to the bolt assembly and the arrow for tracking the arrow;

U.S. Pat. No. 5,971,875 to Hill discloses a vaneless arrow shaft that includes a spinner tube having spiral grooves that is placed within the arrow shaft adjacent the nock end, and the arrow shaft having dimples that engage the grooves so that rotation is imparted to the arrow shaft when the bowstring is released for launching the arrow shaft;

U.S. Pat. No. 6,478,700 B2 to Hartman discloses an arrow spin device that includes a screw shaft having cylindrical leading and tailing ends and which is inserted into the arrow shaft so that engagement by, and release from, the bowstring imparts a spin to the arrow without the need for fletching;

U.S. Pat. No. 6,595,880 B2 to Becker discloses a fluted arrow that can be lighter and stronger than standard arrows, and a fluted arrow that has grooves or spirals along its length to impart rotation to the arrow for increased stability and greater velocity; and U.S. Pat. No. 7,207,908 discloses an insert for allowing free rotation of a cutting tip on an arrow shaft, but does not teach or suggest the presently claimed spinning point.

U.S. Pat. No. 5,269,534 discloses an arrow point with a selectably-adjustable, incrementally-stepped array of weight regulating elements. This patent does not teach the stem having cut points for adjusting the weight of the target point to a more precise weight based on the choice of the archer of the present invention, and discloses nothing about the free rotation of the cutting tip.

U.S. Pat. No. 9,933,239 discloses an arrow field tip bullet that comprises a stem having break-points for adjusting the weight of the archery field tip bullet. However, this patent does not teach the stem having cut points for adjusting the weight of the target point to a more precise weight based on the choice of the archer of the present invention. Moreover, it discloses nothing about the free rotation of the cutting tip, instead teaching a field tip bullet meant to spin faster but along with the spin of the shaft.

U.S. Pat. No. 7,608,001 to Palomaki discloses an arrow system having a shaft having a first end and an insert receptive of a standard point, the insert being disposed completely within the first end of the shaft. An insert installation tool may be used as part of the invention to facilitate insertion of the insert into the first end of the shaft. The invention further includes a reduced diameter hunting arrow shaft that maintains sufficient spine and weight characteristics. The reduced diameter hunting arrow shaft is receptive of standard or non-standard internal components for increasing arrow penetration and shot accuracy. Still further, the invention includes an arrow tip assembly including a male insert and a female point to assist in aligning points with arrow shafts.

U.S. Pat. No. 9,658,036 to Zobell discloses adapter assemblies for arrow assemblies include an insert configured to be received within an arrow shaft and configured to be coupled to a point. The adapter assembly further includes an outer sleeve disposed around at least a portion of the insert. Arrow assemblies include an arrow shaft and an adapter assembly including an insert and an outer sleeve for coupling a point to the arrow shaft.

U.S. Pat. No. 9,638,499 to Perry discloses an insert/outsert assembly for an arrow. The insert includes a cylindrical body having first and second ends. The second end of the insert is dimensioned to fit within the bore of an arrow shaft. The first end includes a prong containing male threads. The outsert includes a cylindrical wall with an arrowshaft end and an arrowhead end. A center bore extends between the arrowshaft and arrowhead ends. The center bore contains a threaded region with female threads located intermediate of the arrowhead end and arrowshaft end. The insert is threadedly connected to the outsert. An arrowhead is threadedly connected to the outsert.

U.S. Pat. No. 8,668,605 to Huang discloses an arrow outsert that includes a first end and a second end. An arrow point bore is formed in the first end of the arrow outsert to receive a cylindrical portion of an arrow point. An arrow shaft bore is formed in the second end of the arrow outsert to receive an arrow shaft. An outer surface of the arrow outsert is preferably tapered starting at the second end. A female thread is formed through a middle of the arrow outsert to threadably engage a threaded stud of the arrow point. A plurality of axial slots are formed in an outer perimeter of the arrow outsert. The arrow outsert is secured to an end of an arrow shaft by applying glue, adhesive or the like, before insertion into the arrow shaft bore. The threaded stud of the arrow point is threaded into the female thread to complete assembly.

U.S. Pat. No. 8,057,330 to Blosser discloses adaptors for mounting arrowheads to arrow shafts. Example embodiments include an outer attachment portion that engages the outer surface of a hollow arrow shaft, and an inner attachment portion that engages the inner surface of the hollow arrow shaft. Other embodiments may include single-piece adaptors configured to receive the end of a hollow arrow shaft, and adaptors with arrowhead receiving portions. Still other embodiments may include an inner attachment portion that is inserted into the hollow of a hollow arrow shaft and an outer attachment portion that surrounds and receives the outer surface of the hollow arrow shaft.

U.S. Pat. No. 5,482,293 to Lekavich discloses a high penetration arrowhead with an adjustable alignment and weight screws onto the end of a hollow arrow shaft. The arrowhead comprises a weight rod which is scored so that pieces can be broken off to adjust its weight.

Nonetheless, despite the ingenuity of the above devices, there remains a need for an improved point of all types discussed herein. Differences in the aerodynamics in the prior art renders much such art inapplicable. There remains a need for an improved assembly for attaching an arrow point to an arrow shaft. A design that provides a secure attachment with perfect alignment and fit, and which permits the user to adjust the weight as needed. To that end, there is a need for an outsert attachment system that will provide for the proper weight, proper fitment, and easy removal from targets.

SUMMARY OF THE INVENTION

The present invention comprehends an adjustable outsert system for the attachment of the ends of an arrow shaft to an arrow point. This invention insures that the longitudinal axis of the outsert and the shaft will be in alignment, and that the weight of the head will be balanced. The invention comprehends that the attachment will provide for adjustability in weight for any preference as far as speed and penetration. The attachment is specifically designed for proper fitment, which will require user modification to arrow shaft, thus ensuring perfect alignment and fit. With this perfect fit and alignment, any wobble is eliminated and the spin rate of the arrow shaft is appropriate.

The present invention also comprises an adjustable post length. This allows for further weight adjustment and also acts as an internal footer strengthening the front of the arrow dramatically. This will result in reduced arrow failure due to excessive impact on the target. The adjustable post length also ensures that the user can adjust the length of the footer for proper spine deflection and allows for a much wider range of broadhead weights without having to switch to a different-spined arrow shaft.

The present invention also comprises an outsert sleeve which is designed solely for durability and dramatically reducing arrow failure due to side load impact on angular shots. Angular shots with use of a broadhead significantly increase side load on all components including shaft. The present sleeve is built to redirect that side load impact and equally distribute the force throughout the outsert sleeve and not on the internal post, dramatically reducing both component and shaft failures.

In the present invention, the available weight options also allow for higher Front Of Center which allows the archer to have more control over arrow flight as well as increasing mass weight, which helps with adding momentum and increasing soft tissue penetration significantly. This combined system also dramatically increases the amount of penetration upon impact with hard bone.

The present invention also comprehends a tapered outsert sleeve which aids in easy arrow removal from targets.

In an embodiment of the present invention, the adjustable outsert is of a generally elongated and cylindrical shape. The adjustable outsert system comprises a point, a sleeve, and a post when assembled. The system is configured to be inserted into an end of an arrow shaft that comprises a hollow receiving portion known in the art. In a preferred embodiment, the hollow receiving portion would be of a dimension sufficient to provide a tight fit for insertion of the post of the outsert system.

The present invention comprises a point. The point comprises a tip (or arrowhead). For purposes of this application, the terms "tip" and "arrowhead" are interchangeable, except when the word "tip" is used to describe a portion of the arrow shaft. The tip or arrowhead can be any type of tip or arrowhead known in the arts, such as a field point, a bodkin point, a blunt, a judo point, a broadhead, a target point, a game getter, or a fishing point, or any other known tip or arrowhead.

In the present invention, the point is axially aligned with the post and the sleeve. The point can be of any screw-in type known in the art, and the point has a first end and a second end. The second end comprises a threaded pin portion with raised helical threading running circumferentially around said pin.

The present invention comprises a post which has a first end and a second end. The first end of the post comprises a receiving portion for attachment to the axially aligned second end of the point. The second end of the post comprises provision of cut points to facilitate the adjustment of the weight of the target point to a more precise weight based on the choice of the archer. The post is sized and weighted to have a certain desired weight before any cuts, such as between 30 and 100 grains. In a preferred embodiment, cut points are formed along the length of the post, extending from the second end of the post toward the first end of the post, so that certain predefined weighted portions may be cut with a suitable cutting tool. In a preferred embodiment, the cut points are spaced evenly along the stem, providing for predefined weighted portions weighing the same amount for each portion. For example, each predefined portion could weigh between 5 and 15 grains. Removal of each weighted portion will incrementally decrease the weight of the point. The post comprising cut points may be made from any suitable material, including but not limited to aluminum or stainless steel or combinations of suitable materials as known in the art After adjusting the weight of the post, the second end of the post is inserted into a receiving portion of the end of the shaft of the arrow.

The present invention also comprises a sleeve having a first end and a second end. The sleeve is cylindrical and of a dimension to allow it to be slipped over the first end of the post following insertion into the receiving portion of the arrow shaft. In a preferred embodiment, the sleeve is tapered, with a larger diameter at the second end. The second end of the sleeve has a diameter greater than the outer diameter of the arrow shaft tip for receiving the tip end of the arrow shaft therein. The decreased diameter toward the first end of the sleeve provides for reduced drag as the arrow passes through the air, and allows for easier removal of the arrow from the target following impact.

This summary of the invention does not necessarily describe all features of the invention. It is provided to introduce a selection of the concepts that are described in further detail in the detailed description and drawings contained herein. This summary is not intended to identify any primary or essential features of the claimed subject matter, nor is it intended to be used as an aid in determining the scope of the appended claims. Each embodiment described herein is not intended to address every object described herein, and each embodiment does not include each feature described. Other forms, embodiments, objects, advantages, benefits, features, and aspects of the present invention will become apparent to one of skill in the art from the detailed description and drawings contained herein.

BRIEF DESCRIPTION OF THE DRAWINGS

These and other features of the invention will become more apparent from reference to the attached drawings, inserted herein below.

REFERENCE NUMERALS IN THE DRAWINGS

1 Point
2 Point First End
3 Point Second End
4 Post
5 Post First End
6 Post Second End
7 Receiving Portion of Post
8 Cut Points
9 Sleeve
10 Sleeve First End
11 Sleeve Second End
12 Predefined Weighted Portions
13 Arrow Shaft

DETAILED DESCRIPTION OF VARIOUS EMBODIMENTS OF THE INVENTION

Various embodiments of the invention are described more fully hereinafter with reference to the accompanying drawings. Some, but not all, embodiments of the invention are shown in the figures. Indeed, the disclosed invention may be embodied in many different forms and should not be construed as limited to the embodiments set forth herein. Rather, these embodiments are provided as examples, and so that this disclosure will satisfy legal requirements.

Figure 1:
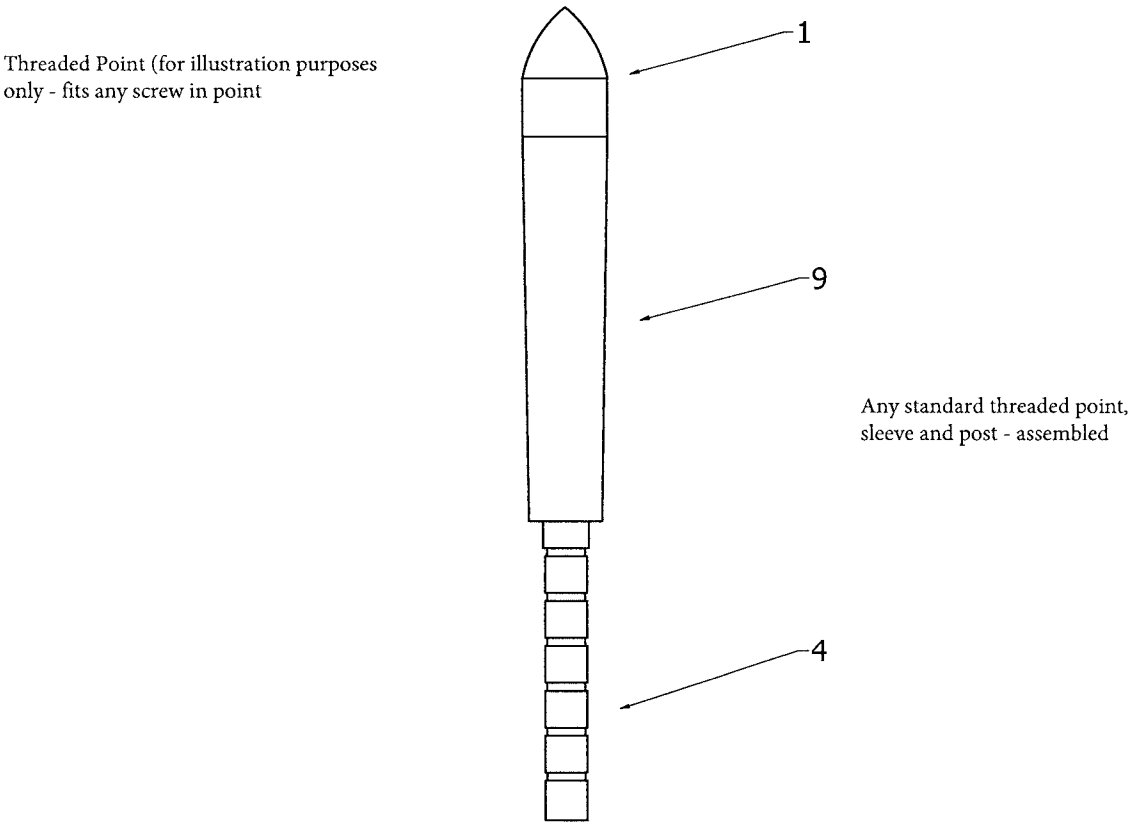
FIG. 1 is an elevational view of the adjustable outsert system of the present invention illustrating the alignment of the field point, sleeve, and post of the present invention.

A first embodiment of the present invention is shown in FIG. 1. FIG. 1 is an elevational view of the adjustable outsert system of the present invention illustrating the assembled system comprising the field point 1, sleeve 9, and post 4 of the present invention.

Figure 2:
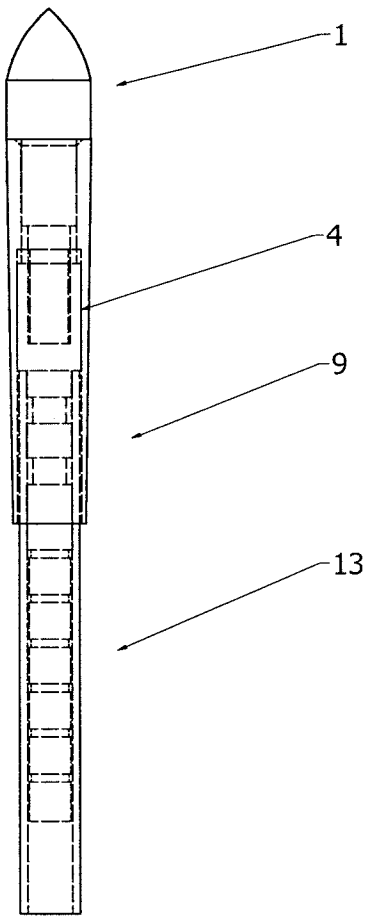
FIG. 2 is an exploded view of the adjustable outsert system of the present invention illustrating the alignment of the field point, sleeve, and post of the present invention
Figure 3:
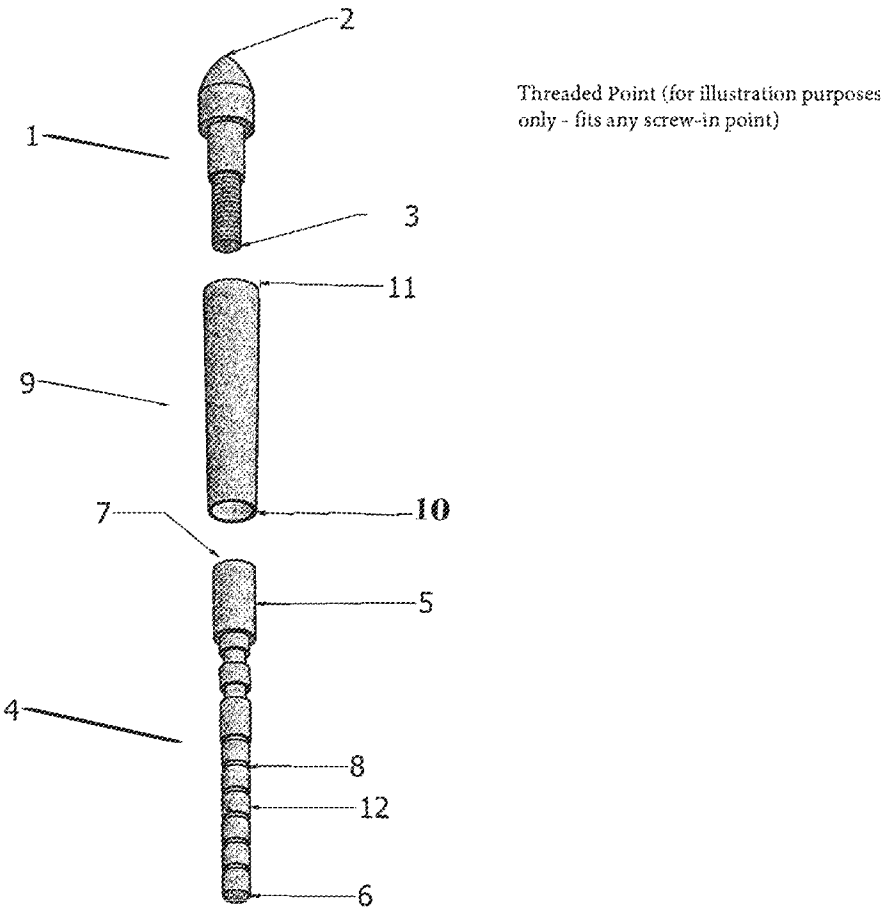
FIG. 3 is another view of the present invention.

FIG. 2 shows an exploded view of an embodiment of the adjustable outsert system of the present invention illustrating the alignment of the field point 1, sleeve 9, and post 4 of the present invention. As illustrated, the second end of the point 3 is received by the receiving end 7 at the first end of the post 5. The second end of the post 6 is inserted into a receiving portion of the tip end of an arrow shaft. Before such insertion of the post, the weight and length of the post are adjustable. The post 4 is sized and weighted to have a certain desired weight before any cuts, such as between 30 and 100 grains. Cut points 8 are formed along the length of the post 4 from the second end of the post 6. The predefined weighted portions 12 may be cut with a suitable cutting tool. After such cutting, the shortened (and weight adjusted) post 6 may be attached to the arrow shaft. In a preferred embodiment, the cut points are spaced evenly along the post 6, providing for predefined weighted portions 12 weighing the same amount for each portion. For example, each predefined portion could weigh between 5 and 15 grains. Removal of each weighted portion will incrementally decrease the weight of the point. The post 6 comprising cut points 8 may be made from any suitable material, including but not limited to aluminum or stainless steel or combinations of suitable materials as known in the art.

As shown in FIGS. 1 and 2, the adjustable outsert system comprises a point, a sleeve, and a post when assembled. The system is configured to be inserted into an end of an arrow shaft that comprises a hollow receiving portion known in the art. In a preferred embodiment, the hollow receiving portion would be of a dimension sufficient to provide a tight fit for insertion of the post of the outsert system. The point can be any type of tip or arrowhead known in the arts, is axially aligned with the post and the sleeve, can be of any screw-in type known in the art, and has a first end and a second end. The post bas a first end and a second end, with the first end of the post comprising a receiving portion for attachment to the axially aligned second end of the point. The second end of the post comprises provision of cut points to facilitate the adjustment of the weight of the target point to a more precise weight based on the choice of the archer. The sleeve has a first end and a second end, is cylindrical and of a dimension to allow it to be slipped over the first end of the post following insertion into the receiving portion of the arrow shaft. The sleeve is tapered in a preferred embodiment, with a larger diameter at the second end. The first end of the sleeve has a diameter greater than the outer diameter of the arrow shaft tip for receiving the tip end of the arrow shaft therein. The decreased diameter toward the first end of the sleeve provides for reduced drag as the arrow passes through the air, and allows for easier removal of the arrow from the target following impact.

In a further preferred embodiment, the outsert system of the present invention is comprised of a two-part system. The first part is comprised of a post 4, which acts as an internal footer with precisely marked cutoff sections 8 for adjusting the overall weight. By adjusting the weight, the archer is able to perfectly tune the arrow shaft for dynamic spine as well as customized F.O.C (forward of center). The benefits of these adjustments will allow the archer to maximize arrow flight characteristics, tunability, and penetration. The post 4 length being longer than the outer sleeve 9 acts as an internal footer strengthening the front portion of the arrow shaft, making it more durable and significantly reducing sidewall pressure on the arrow shaft, eliminating sidewall blowouts (breakage) on both head-on and angular hard impacts. The second part of the two-part system is the sleeve 9 which acts as an external footer. This part of the system is to significantly increase structural integrity and strength of the entire front of the arrow shaft and component system. In this preferred embodiment, the sleeve 9 goes over the front of the internal post 4 and over a portion of the arrow shaft itself, thereby strengthening the joint of the internal post and shaft. The sleeve, acting as an external footer, also redirects the energy from impact evenly in a 360-degree manner down the component system and shaft. This dramatically reduces the amount of energy exerted on the internal post and walls of the shaft on both head-on and angular impacts. This reduces damage such as bending or breaking of the internal portion of the post and breakage of the shaft itself. In the preferred embodiment, the first part of the two-part system (the internal footer or post) is specifically designed with glue grooves and strategically-placed cut marks to guide the user in adjusting the weight of said post.

It is further designed to be a press-fit inside the shaft, thereby reducing space between the post and the internal wall of the arrow shaft. Eliminating space between the post and the arrow shaft ensures no movement especially on hard angular impact significantly reducing energy transfer to the sidewall of the shaft. Moreover, the first part (internal footer or post) is longer than the second part of the system (sleeve or external footer). The longer post compared to the sleeve provides for the transfer of the energy from an angular hard impact throughout a greater distance thus greatly reducing the energy transferred to the internal sidewall of the arrow shaft. The second part of the two-part system (external footer or sleeve) is designed to slide over part 1 of the system (post or internal footer) as well as over the arrow shaft. It is further designed to fit over part 1 (post or internal footer) with just enough space to slide over creating a press-fit. Eliminating the space between the part 1 (post or internal footer) ensures zero movement on angular or hard impact. After sliding over the first part (post or internal footer), the second part (external footer or sleeve) continues past the joint where the arrow shaft meets the shoulder of the post or internal footer, thereby strengthening the joint. Eliminating all space between the internal surface of the second part and the external surface of the arrow shaft and the first part (internal footer or post) allows the energy transfer to be directed into the second part (sleeve or external footer), thereby evenly distributing energy upon impact, whether 90° or angular. This even transfer in a 360 degree fashion dramatically reduces the energy transferred into the part 1 (post or internal footer) and is redirected evenly down the arrow shaft.

It is an objective of the present invention to provide an outsert with an adjustable post length to allow for weight adjustment and to serve as an internal footer strengthening the front of the arrow to protect the arrow from failure.

It is an objective of the present invention to provide an outsert with an outsert sleeve which is designed solely for durability and dramatically reducing arrow failure due to side load impact on angular shots.

It is an objective of the present invention to provide an outsert that provides for more control over arrow flight as well as increasing mass weight, which helps with adding momentum and increasing soft tissue penetration significantly.

It is an objective of the present invention to provide an outsert that comprehends a tapered outsert sleeve which aids in easy arrow removal from targets.

A preferred embodiment of the invention is disclosed herein, and it should be understood that numerous modifications, alterations, and variations are possible and practicable by those skilled in the art while still coming within the spirit of the invention and scope of the invention as set forth in the appended claims. While the foregoing written description and drawings of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed. Moreover, the terms "consisting", "comprising" and other derivatives from the term "comprise" are intended to be open-ended terms that specify the presence of any stated features, elements, steps, or components, and are not intended to preclude the presence or addition of one or more other features, elements, integers, steps, components, or groups thereof. Moreover, Applicants have endeavored in the present specification and drawings to draw attention to certain features of the invention, it should be understood that the Applicant claims protection in respect to any patentable feature or combination of features referred to in the specification or drawings. The drawings are provided to illustrate features of the invention, but the claimed invention is expressly not limited to the illustrated embodiments.

I claim:

1. An adjustable outsert system for attaching a point having a first end and a second end to an arrow shaft, said adjustable outsert system comprising:

a sleeve and a post, wherein said adjustable outsert system, when assembled, is adapted to be partially inserted into an end of said arrow shaft that comprises a hollow receiving portion, wherein said point having a threaded portion and an unthreaded cylindrical portion, said unthreaded cylindrical portion having a constant diameter between first and second ends of said unthreaded cylindrical portion, and a tip end;

said post has a first end and a second end, with the first end of the post comprising a receiving portion adapted for attachment to the threaded portion of the point, and said first end of said post having a larger outer diameter than said second end of said post, and the second end of the post comprises provision of cut points to facilitate adjustment of a weight of the adjustable outsert system to a more precise weight based on a choice of an archer, a plurality of annular grooves of differing depth than said cut points, said plurality of annular grooves disposed immediately adjacent to said receiving portion and located between the receiving portion of said post and said plurality of cut points, said threaded portion of said point being spaced axially outward of said arrow shaft, said post being dimensioned to fit tightly inside said hollow receiving portion of said arrow shaft upon insertion therein and said larger outer diameter portion of said post abutting an end face of said arrow shaft, said sleeve is generally cylindrical with an outer surface, said outer surface has a second end having a larger diameter and external taper to a first end having a smaller diameter, and an inner surface, wherein said second end is dimensioned to be adapted for slipping over the first end of the post following insertion of said post into the hollow receiving portion of the arrow shaft, and wherein said first end of the sleeve has a diameter adapted dimensionally to be press-fit over said arrow shaft upon installation thereon, and wherein said first end of the sleeve covers an end portion of an outer diameter of said arrow shaft and the second end of the sleeve engages said point when assembled, wherein an end of said unthreaded cylindrical portion of said point engages said first end of said post and provides a space between said first end of said post and a flat surface of said point where said unthreaded cylindrical portion extends from said tip end;

wherein said cut points are non-brittle and cuttable only with a suitable cutting tool, and wherein said post extends into said end of said arrow shaft further than said sleeve extends over said outer diameter of said arrow shaft.

2. The adjustable outsert system of claim 1, wherein said cut points are spaced to divide said post into predefined weighted portions weighing 5 to 25 grains each.

3. The adjustable outsert system of claim 1, wherein said first end of the sleeve has a diameter adapted dimensionally to fit tightly over the outer diameter of the tip end of the arrow shaft.

4. The adjustable outsert system of claim 1, wherein said first end of the sleeve has a diameter slightly smaller than the outer diameter of said tip end of the arrow shaft.

5. An adjustable outsert system comprising:

(1) a first part, comprising a post adapted for insertion into an end portion of an arrow shaft, said post being dimensioned to be fit inside said end portion of said arrow shaft upon insertion therein, said post having an end with a larger diameter to engage an end face of said arrow shaft, said post having a threaded receiving portion, a plurality of annular glue grooves immediately adjacent to said threaded receiving portion, (2) a second part, comprising a tapered sleeve sized to cover the front of the post and said end portion of an outer diameter of said arrow shaft, said tapered sleeve having an outer surface with larger diameter at a second end and smaller diameter at a first end, and an inner surface between said first end and said second end of said tapered sleeve, further being sized to be press-fit over said arrow shaft upon installation thereon, said inner surface of said tapered sleeve also directly contacting a stud extending from a threaded end of an arrow point, said stud having a constant diameter, wherein an end of an unthreaded cylindrical portion of a point engages said end of said post to provide a space between said end of said post and a flat surface of said point from which said unthreaded cylindrical portion extends;

wherein said first part is provided with precisely marked cutoff sections for adjusting overall weight, and wherein said cutoff sections are non-brittle and cuttable only with a suitable cutting tool, an annular cut point disposed between said cutoff sections, wherein each of said annular grooves has a deeper radial depth than each of said annular cut points, and wherein said post extends into said end portion of said arrow shaft further than said tapered sleeve extends over said outer diameter of said arrow shaft and further wherein said a threaded receiving portion of said post being spaced axially forward of said end of said arrow shaft when said post is fully inserted in said arrow shaft.

6. The adjustable outsert system of claim 5, wherein said cut points guide a user in adjusting the weight of said post.

7. An adjustable outsert system adapted for partial insertion into an end of an arrow shaft, comprising:

an internal adjustable footer and an external footer, said internal adjustable footer extends axially within said arrow shaft, said internal adjustable footer having a plurality of measured cut points that are non-brittle and cuttable only with a suitable cutting tool, said cut points defined by grooves, said internal adjustable footer comprises a post which is configured to threadably receive a point, said point having an unthreaded cylindrical portion of a larger diameter which engages a first end of said post, said post having a plurality of annular glue grooves which have a radially deeper depth than said grooves defining said cut points, said plurality of annular glue grooves being disposed immediately adjacent to said post and between said post and said cut points, said external footer extends axially external an outer diameter of said arrow shaft and comprises an inner surface extending between a first end and a second end of said external footer, wherein said internal adjustable footer extends into said end of said arrow shaft further than said external footer extends over said outer diameter of said arrow shaft, wherein a forward of center weight is adjustable by an archer by adjusting a weight of said adjustable outsert system by adjusting said internal adjustable footer, wherein said internal adjustable footer is dimensioned to be fit tightly within said arrow shaft upon installation therein and said internal adjustable footer has a second end of said post of said larger diameter which abuts and end face of said arrow shaft, and wherein engagement of post and said point provides a space between said first end of said post and a flat surface of said point where said unthreaded cylindrical portion extends from a tip end of said point, wherein said external footer is dimensioned to be press-fit to said arrow shaft upon installation thereon.

* * * * *